United States Patent [19]

Bianchi

[11] Patent Number: 4,991,272

[45] Date of Patent: Feb. 12, 1991

[54] QUICK RELEASE BUCKLE

[76] Inventor: John E. Bianchi, 100 Calle Cortez, Temecula, Calif. 92390

[21] Appl. No.: 230,309

[22] Filed: Aug. 9, 1988

[51] Int. Cl.[5] ..... A44B 11/25

[52] U.S. Cl. ..... 24/616; 24/615; 24/313

[58] Field of Search ..... 24/616, 615, 618, 196, 24/313

[56] References Cited

U.S. PATENT DOCUMENTS

| | | | |
|---|---|---|---|
| 1,278,783 | 9/1918 | Stoner | 24/585 |
| 2,173,818 | 9/1939 | Baumer | 24/625 |
| 2,178,572 | 11/1939 | Forstner | 24/616 |
| 3,844,000 | 10/1974 | Hedu | 24/615 |
| 3,967,351 | 7/1976 | Rosenberg et al. | 24/616 |
| 4,150,464 | 4/1979 | Tracy | 24/615 |
| 4,282,634 | 8/1981 | Krauss | 24/313 |
| 4,425,689 | 1/1984 | Fildan | 24/616 |
| 4,559,679 | 12/1985 | Downey | 25/615 |
| 4,569,106 | 2/1986 | Lovato | 24/615 |
| 4,712,280 | 12/1987 | Fildan | 24/615 |

*Primary Examiner*—Victor N. Sakran

*Attorney, Agent, or Firm*—Wagner & Middlebrook

[57] ABSTRACT

A resilient plastic buckle assembly utilizes a pair of identical bases for connecting a receptacle and for connecting a clasp to a belt or the like. Bosses and slots on the receptacle and clasp guide the insertion of the clasp into the receptacle and insure their correct relative orientation. Cantilevered latching wings integral with the body of the clasp engage openings in the receptacle and are manually depressible to release the clasp from the receptacle.

3 Claims, 4 Drawing Sheets

FIG. 5
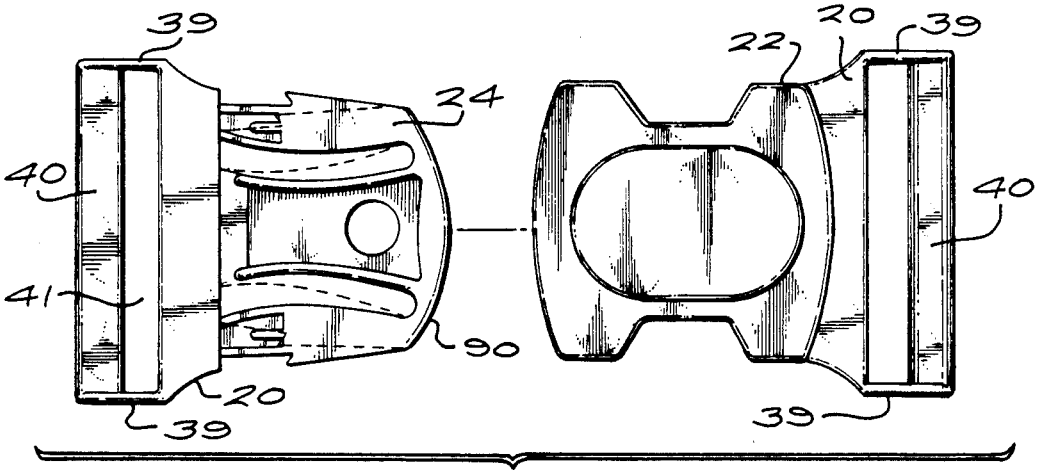
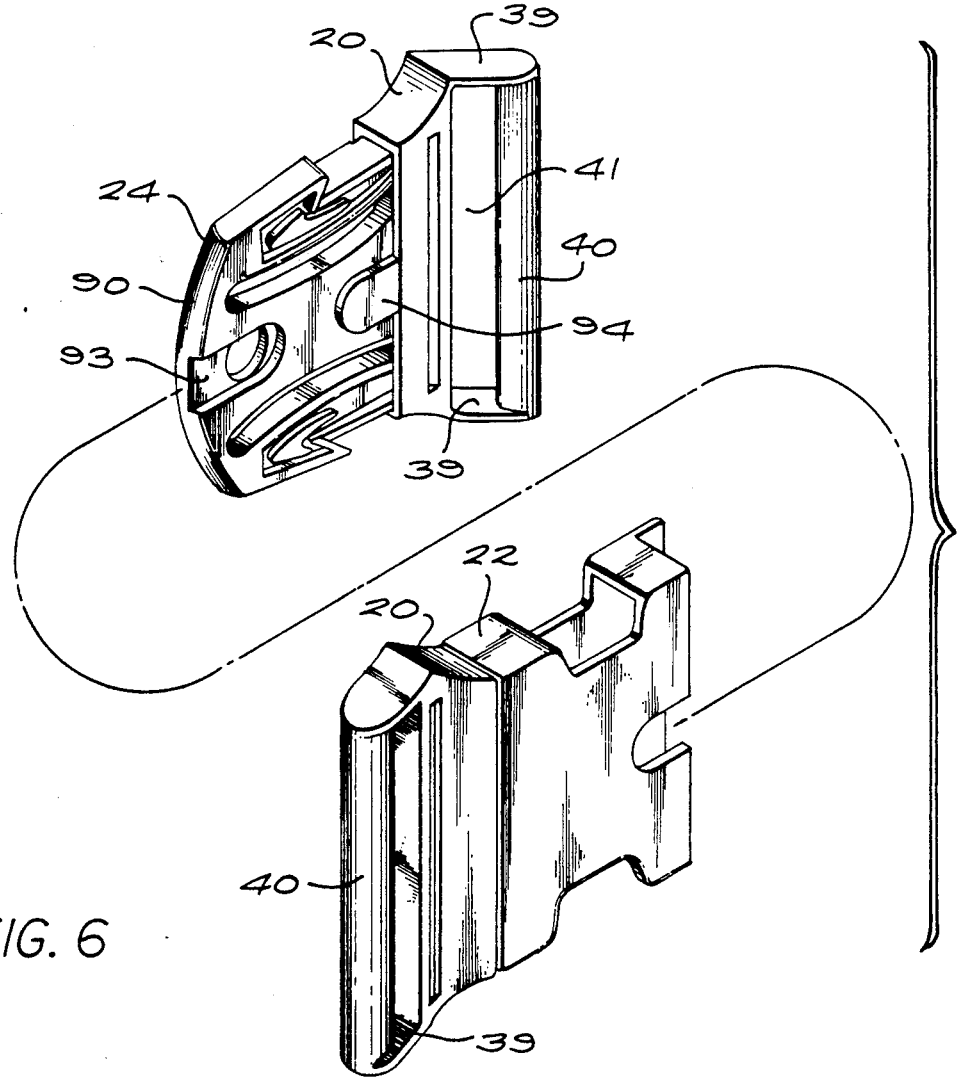
FIG. 6

FIG. 7
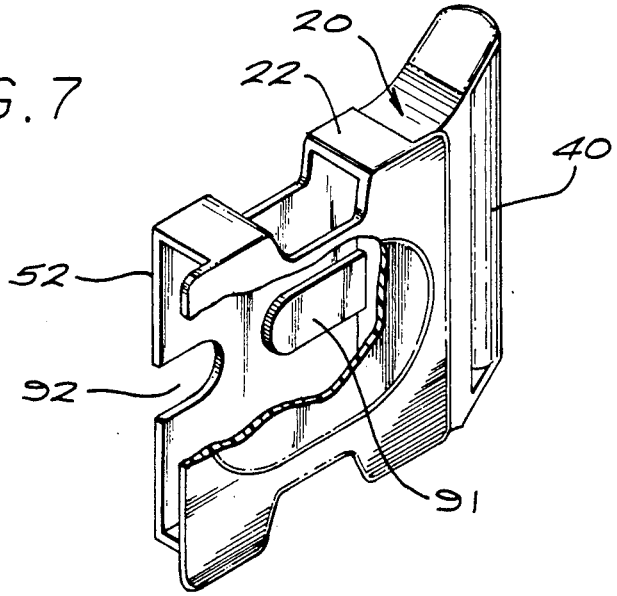
FIG. 9
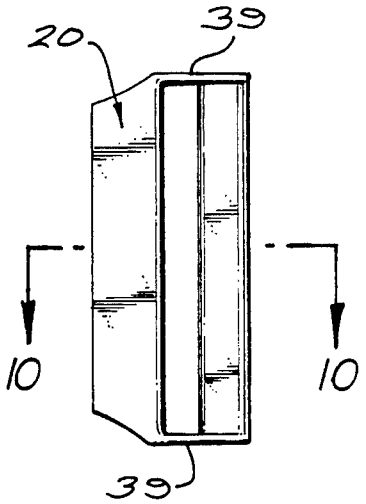
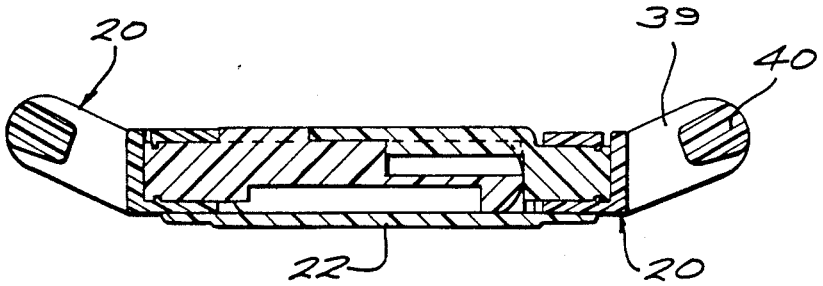
FIG. 8
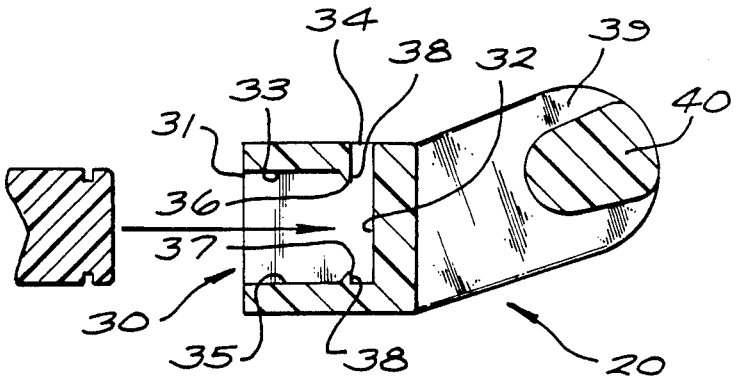
FIG. 10

FIG. 11
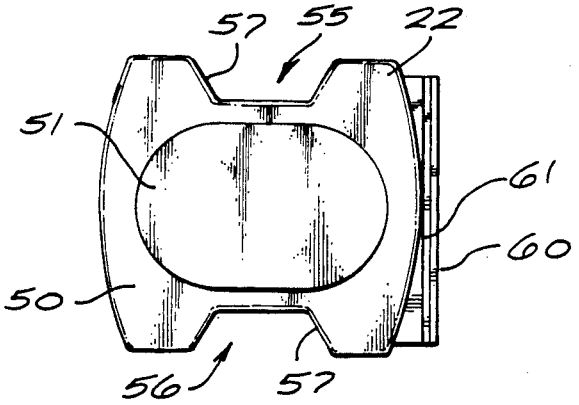
FIG. 13
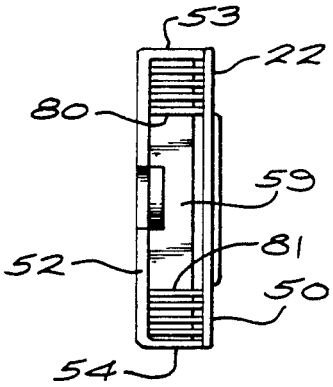
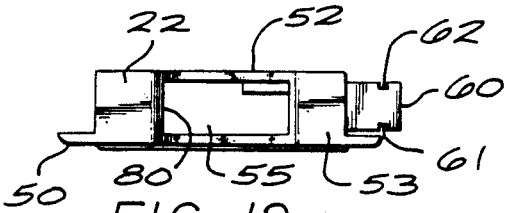
FIG 12
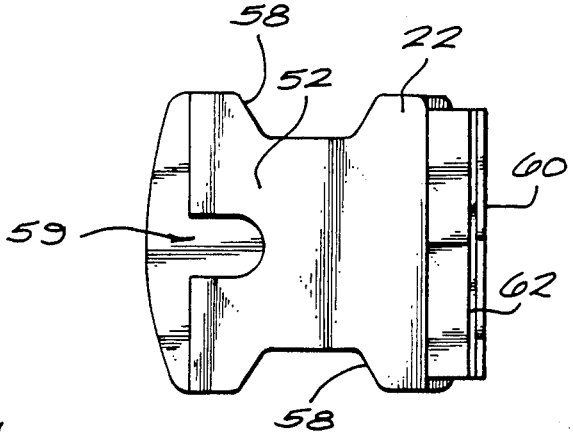
FIG. 14
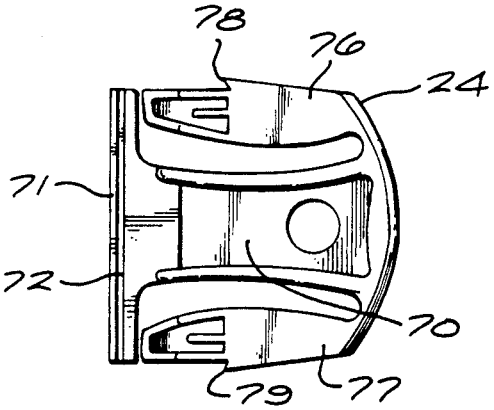
FIG. 15
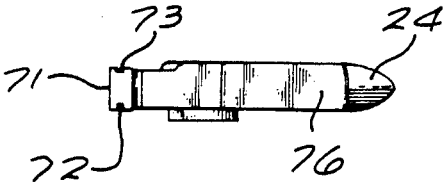
FIG. 16
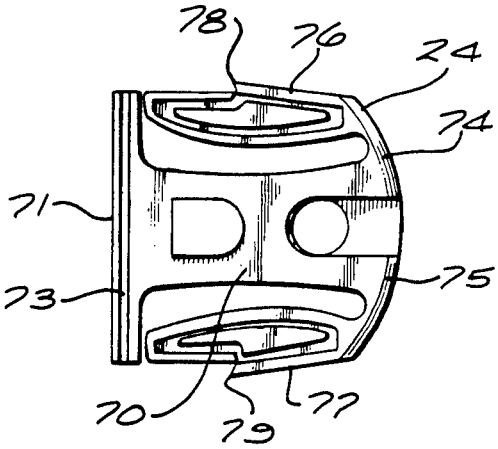
FIG. 17

QUICK RELEASE BUCKLE

BACKGROUND OF THE INVENTION

1. Field Of The Invention

The present invention relates to buckle assemblies for releasably joining the ends of belt or the like and more particularly to an improved, rugged design of buckle adapted to be molded of plastic material and rapidly assembled without the use of tools.

2. Description Of The Prior Art

A variety of designs of devices for releaseably joining the ends of belts or the like comprise a hollow, generally flat receptacle adapted for attachment to one end of the belt or similar member and provided at its opposite end with an opening for insertion of a clasp adapted for attachment to the other end of the belt and capable of releaseably engaging recesses in the wall of the receptacle. Devices of this kind are shown and described in the U.S. Pat. No. to Rosenberg et al., No. 3,967,351 for a "Clasp" and to Tracy, No. 4,150,464 for a "Buckle".

SUMMARY OF THE INVENTION

The buckle assembly of the present invention comprises a pair of identical base members provided with means for attachment to the ends of a belt or the like, a receptacle capable of being assembled into permanently latched engagement with one of the base members without the use of any tool, and a clasp releaseably engagable with the receptacle and also capable of being assembled into permanently latched engagement with one of the base members without the use of any tool.

The releasable engagement between the clasp and receptacle is effected by resilient cantilevered arms formed on the clasp on a substantially parallel central portion which prevents over stressing of the arms; the central portion and bases of the arms presenting a rounded leading edge for guiding the clasp into the receptacle. Mating bosses and recesses of the clasp and receptacle assist in such guiding and also prevent latching of the clasp within the receptacle in other than a proper orientation.

BRIEF DESCRIPTION OF THE DRAWINGS

FIG. 5 is a view in front elevation of the buckle assembly of FIG. 2 with the receptacle and clasp separated;

FIG. 6 is a view in perspective of the rear of the buckle assembly of FIG. 2 with the clasp assembly and receptacle assembly separated.

FIG. 7 is a view in perspective of the front of the receptacle assembly with a portion cut away to display its interior structure;

FIG. 8 is a view in section of the buckle assembly of FIG. 2 taken on the line 8—8 of FIG. 2;

FIG. 9 is a view in end elevation of the receptacle assembly of FIG. 7;

FIG. 10 an enlarged detail view in section taken on the line 10—10 of FIG. 9, but with the base and receptacle separated to show the junction of the base and either a receptacle or a clasp;

FIG. 11 is a view in front elevation of the receptacle of the buckle assembly separated from the base.

FIG. 12 is a view in plan of the receptacle of FIG. 11;

FIG. 13 is a view in end elevation of the receptacle of FIG. 11 as seen from its open end;

FIG. 14 is a view in rear elevation of the receptacle of FIG. 11;

FIG. 15 is a view in front elevation of the clasp separated from the base;

FIG. 16 is a view in plan of the clasp of FIG. 15;

FIG. 17 is a view in rear elevation of the clasp of FIG. 15.

DETAILED DESCRIPTION OF THE PREFERRED EMBODIMENT

As shown in the accompanying drawings, the buckle assembly of the present invention comprises a pair of identical bases 20, a receptacle 22 and a clasp 24 each of which is molded of a tough, resilient material such as nylon.

Figure 1:
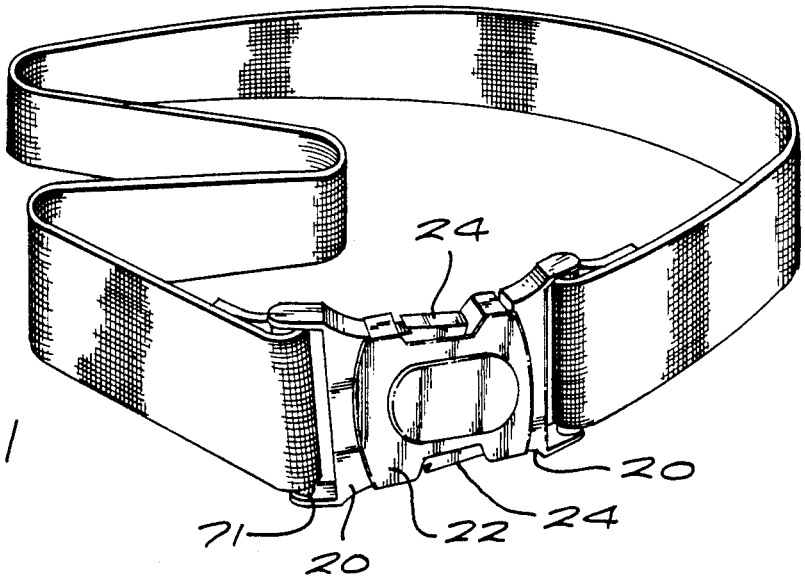
FIG. 1 is a view in perspective of a closed, quick release buckle assembly embodying the present invention, attached to a belt.
Figure 2:
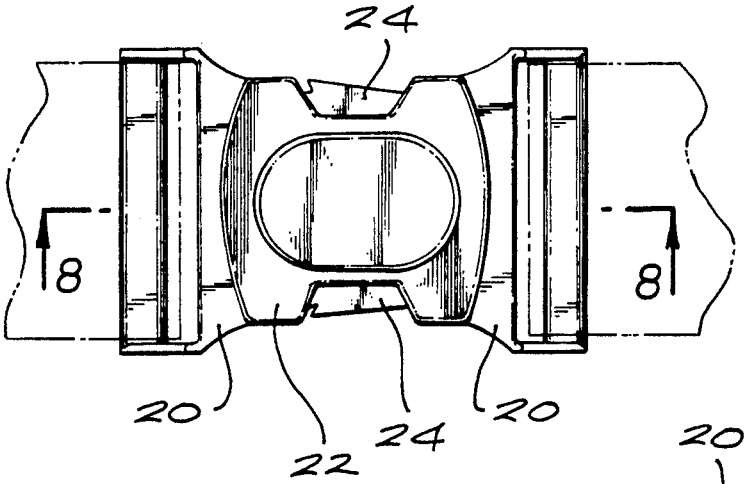
FIG. 2 is a larger view in front elevation of the buckle assembly of FIG. 1, with the belt ends shown in ghosted lines.
Figure 3:
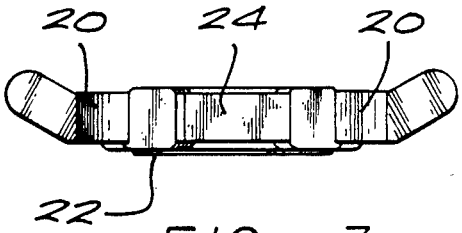
FIG. 3 is a view in plan of the buckle assembly of FIG. 2.
Figure 4:
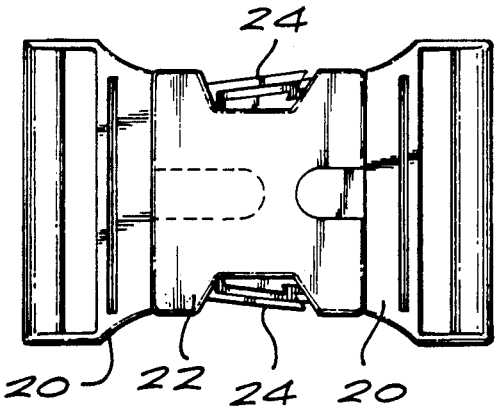
FIG. 4 ia a view in rear elevation of the buckle assembly of FIG. 2.

The bases 20 (FIGS. 7–10) comprise a channel 30 which has closed ends 31, a bottom wall 32, an inner wall 33 separated from the bottom wall by a slot 34, and an outer wall 35. Formed integrally with these inner and outer walls are transversely extending ribs 36 and 37, coextensive with the slot 34, each of which has a surface 38 facing the bottom wall 32 normal to the wall on which it is formed. At its upper and lower extremities, the base 20 is provided with outwardly extending arms 39 which are joined by a cross piece 40 defining a space 41 between it and the bottom wall 32 of channel 30 through which the ends of the belt or the like may be looped as shown at 41 (FIG. 1).

The receptacle 22, as shown in FIGS. 11–14, has a front wall 50 presenting a surface 51 on which insignia may be displayed, a back wall 52, upper, lower walls 53 and 54 which are relatively narrower than the front and back walls, and an opening 59 at one side for reception of the clasp 24. The upper and lower walls 53 and 54 are provided with finger openings 55 and 56 which extend a short distance into the front and back walls 50 and 52 as indicated at 57 (FIG. 11) and 58 (FIG. 14).

Formed integrally with the receptacle 22 is a receptacle connection bar 60 dimensioned to fit closely within the channel 30 of one of the bases 20. Front and rear grooves 61 and 62 having side walls normal to the faces of the bar in which they are formed are positioned in bar 60 to receive ribs 36 and 37 of the base 20 respectively when bar 60 is fully inserted into the channel 30; this rib and groove assembly constituting a ratchet joint permanently locking the receptacle and a base together.

The clasp 24, as shown in FIGS. 15–17, has a central portion 70 on one end which there is formed integrally therewith a clasp connection bar 71. Clasp connection bar 71 is, as in the case of the receptacle connection bar 60, dimensioned to fit closely within the channel 30 of the base 20, and is provided with inner and outer grooves 72 and 73 positioned to receive the ribs 36 and 37 of the base 20, respectively, when bar 71 is fully inserted into the channel 30; this rib and groove structure constituting a ratchet joint permanently locking the base and clasp together.

Formed on the end of the central portion 70 opposite the clasp connection bar 71 are flexible, resilient portions 74 and 75 terminating in an upper cantilevered latching arm 76 and a lower cantilevered latching arm 77 which are disposed generally parallel to and coextensive with the central portion 70. Upper latching arm wing 76 is provided with a hooked portion 78 positioned to engage over an edge 80 (FIGS. 12–13) of the upper finger opening 55 of the receptacle 22, and the lower latching arm 77 is provided with a hooked portion 79 positioned to engage over an edge 81 of the lower finger opening 56 of the receptacle 22 when the clasp, after insertion in the receptacle, is pulled outwardly.

The preferred embodiment of the present invention includes means for guiding the insertion of the clasp into the receptacle and for preventing insertion to latching position in other than the correct relative orientation of the receptacle and clasp. For this purpose the edge of the clasp 24 which is the leading edge when the clasp is attached to a belt, is rounded s shown at 90 in FIGS. 5 - 6, the inner side of the back wall 52 of the receptacle 22 carries a boss 91 (FIG. 7) which is rounded on the end toward the open end of the receptacle, a complementary notch 93 is provided in the receptacle, the central portion 70 of the clasp carries a boss 94 and a complementary notch 92 is provided in the central portion 70 of the clasp 24.

This arrangement is such that when the clasp is inserted in the receptacle in proper orientation, the bosses 91 and 94 will enter the notches 92 and 93, permitting the clasp to enter the receptacle to the latched position in which the parts are shown in FIG. 1. However, if an attempt is made to insert the clasp into the receptacle in an inverted position, the boss 94 on the clasp will, by engaging the edge of the front wall 50 of the receptacle, prevent the clasp from entering far enough to effect latching of the clasp within the receptacle.

It will be understood that variations, omissions and additions to this preferred embodiment of the invention will occur to persons familiar with the design of such devices and that the invention is not to be considered as limited to the embodiment shown and described except as required by the prior art and the following claims.

I claim:

1. In a receptacle and clasp assembly comprising a hollow receptacle having an open end, a clasp receivable in said receptacle through its open end, and means for releasably latching said clasp within said receptacle, the improvement comprising a pair of separate substantially identical bases;

and means for permanently latching one of said bases to either said receptacle or said clasp comprising:

interengageable channel and connection bar means on said bases on the one hand and on said receptacle and said clasp on the other hand and interengageable ratchet joint elements on said bases on the one hand and on said receptacle and said clasp on the other hand;

said ratchet joint elements, when interengaged, being located entirely within said channels, and being inaccessible from the exterior thereof.

2. A receptacle and clasp assembly comprising a hollow receptacle having relatively wider front and back walls, relatively narrower top and bottom walls, and an open end; a clasp receivable in said receptacle through said open end, and means for releasably latching said clasp within said receptacle; the improvement comprising means for guiding said clasp during insertion thereof into said receptacle including a boss on the interior of one of the front and back walls of said receptacle presenting a camming surface toward the open end of said receptacle, a slot in said clasp engageable with said boss as an incident to insertion of said clasp into said receptacle, a slot in one of the front and back walls of said receptacle, a boss on said clasp presenting a camming surface toward the open end of said receptacle during insertion of said clasp into said receptacle, and a slot in said clasp, said last mentioned slot being engageable with the boss on the wall of said receptacle and the slot in the wall of said receptacle being engageable with the boss on said clasp as an incident to insertion of said clasp in said receptacle.

3. In a receptacle and clasp assembly comprisng a hollow receptacle having relatively wider front and back walls, relatively narrower top and bottom walls provided with finger openings in said top and bottom walls extending into said front and back walls, an open end, and a clasp receivable in said receptacle through said open end and means carried by said clasp for latching the same in engagement with said receptacle upon full insertion of said clasp within said receptacle; the improvement comprising means preventing insertion of said clasp to such latching position in said receptacle in other than a single relative orientation of said clasp and receptacle; said insertion preventing means including a longitudinally separated boss and notch on one side of said clasp and a longitudinally separated boss and notch one side of said receptacle; the boss on said one side of said receptacle being complementary in shape and position to the boss and notch on the said one side of said clasp.

* * * * *